US006868790B1

(12) United States Patent
Gieseke et al.

(10) Patent No.: US 6,868,790 B1
(45) Date of Patent: Mar. 22, 2005

(54) HIGH VELOCITY UNDERWATER JET WEAPON

(75) Inventors: Thomas J. Gieseke, Newport, RI (US); Robert Kuklinski, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/730,187

(22) Filed: Dec. 8, 2003

(51) Int. Cl.[7] ..... F42B 12/46
(52) U.S. Cl. ..... 102/367
(58) Field of Search ..... 102/367; 89/7; 60/221; 181/120; 367/146; 440/45; 239/372, 99, 101

(56) References Cited

U.S. PATENT DOCUMENTS

| | | | | | |
|---|---|---|---|---|---|
| 1,117,351 | A | * | 11/1914 | Edlin | 60/221 |
| 2,714,800 | A | * | 8/1955 | Gongwer | 60/221 |
| 2,960,031 | A | * | 11/1960 | Clift | 102/443 |
| 3,949,831 | A | * | 4/1976 | Cassand et al. | 181/120 |
| 4,058,256 | A | | 11/1977 | Hobson et al. | |
| 4,185,714 | A | * | 1/1980 | Pascouet et al. | 181/120 |
| 4,231,283 | A | * | 11/1980 | Malburg | 89/8 |
| 4,234,052 | A | * | 11/1980 | Chelminski | 181/120 |
| 4,240,518 | A | * | 12/1980 | Chelminski | 181/107 |
| 4,303,141 | A | * | 12/1981 | Pascouet | 181/120 |
| 4,341,173 | A | * | 7/1982 | Hagelberg et al. | 114/20.2 |
| 4,555,872 | A | * | 12/1985 | Yie | 451/40 |
| 4,594,697 | A | * | 6/1986 | Pascouet | 367/146 |
| 4,603,409 | A | * | 7/1986 | Jaworski | 367/146 |
| 4,607,792 | A | | 8/1986 | Young | |
| 4,718,870 | A | * | 1/1988 | Watts | 440/47 |
| 4,779,245 | A | * | 10/1988 | Chelminski | 367/144 |
| 4,798,261 | A | | 1/1989 | Chelminski | |
| 4,928,783 | A | * | 5/1990 | Crook | 181/106 |
| 4,934,242 | A | * | 6/1990 | Bulman | 89/7 |
| 4,969,399 | A | * | 11/1990 | Kish | 102/402 |
| 5,061,454 | A | * | 10/1991 | Birk | 422/119 |
| 5,136,920 | A | | 8/1992 | Breed et al. | |
| 5,142,509 | A | * | 8/1992 | Dolengowski | 367/144 |
| 5,344,345 | A | * | 9/1994 | Nagata | 440/44 |
| 5,417,550 | A | * | 5/1995 | Kasai et al. | 417/151 |
| 5,425,504 | A | | 6/1995 | Patterson | |
| 5,664,631 | A | * | 9/1997 | Szocs | 169/70 |
| 5,692,371 | A | * | 12/1997 | Varshay et al. | 60/221 |
| 2002/0079383 | A1 | | 6/2002 | Forrest | |

* cited by examiner

*Primary Examiner*—Teri P. Luu
*Assistant Examiner*—Jordan Lofdahl
(74) *Attorney, Agent, or Firm*—James M. Kasischke; Michael P. Stanley; Jean-Paul A. Nasser

(57) ABSTRACT

An assembly, a system and a method of use for producing a pulsed jet used to carry a high velocity jet of fluid through water. The energy of this jet is to be used as a weapon against undersea targets. The assembly includes a pressure chamber, a manifold, and a nozzle. In use, the pressure chamber is filled with fluid and a pressure is generated within the chamber by injecting and igniting fuel adjacent the fluid thereby forcing the fluid out the nozzle. The forced fluid is directed to create a high velocity jet of fluid. The fuel can be ignited repeatedly to produce follow-on jets, each impacting the preceding high velocity jet.

10 Claims, 3 Drawing Sheets

HIGH VELOCITY UNDERWATER JET WEAPON

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to underwater weapons and more particularly, to directed energy high velocity jets used as an underwater weapon.

(2) Description of the Prior Art

As known in the art, undersea projectiles are considered a weapon to defeat undersea targets. Projectiles (similar to projectile 10 of FIG. 1), have been demonstrated for use. The projectiles are based on standard munitions with explosive cartridges launching the projectiles from a gun. Although the use of projectiles is an effective and low-risk approach for defeating underwater targets, the use presents a number of problems. In a first example, the launch system must be kept dry which further creates technical problems. In a second example of the problems of use, the combustion gasses produced by launch limit the rate of fire of the gun or weapon as these gasses interfere with flight of salvos of the projectiles 10. In a third example of the problems of use, the projectiles 10 interfere with each other in flight, further limiting rates of fire. In a final but not exhaustive example of the problems of use, the projectiles 10 occupy a very small portion of the supercavity 12 that they generate therefore utilizing a small percentage of the potential benefits of the supercavity 12.

It has been further demonstrated that forward-directed jets 20 from moving vehicles 22 (shown in FIG. 2) can produce supercavities 24 in a manner similar to a physical cavitator. As shown in the figure, the jet 20 advances forward of the vehicle 22 such that a moving front 26 is produced. The size and shape of the cavity 24 are related to the diameter of the forward directed jet 20 and the advancement speed of the moving front 26.

Referring again to FIG. 1, the shape of the cavity 12 is assumed to be elliptical as defined by $$\left(\frac{x-l/2}{l/2}\right)^m+\left(\frac{r}{R}\right)^n=1,$$

where x is the distance along the axis of the cavity 12, l is the length of the cavity, r is the radius of the cavity, and R is the maximum radius of the cavity. The exponents are selected using the approximation as m=2 and n=2.4. Two other parameters are required to define the shape of the supercavity 12: $\lambda(\sigma)$ and $\mu(\sigma, C_D)$. $C_D$ is the cavitator drag coefficient based on the cavitator projected area and $\sigma$ is the cavitation number defined as:

$$\sigma=\frac{P_\infty-P_c}{1/2\rho U^2}$$

where $\rho$ is the fluid density, $P_\infty$ is the ambient pressure, $P_C$ is the pressure of the cavity 12, and U is the speed of the projectile 10. The first parameter, the ratio of the maximum diameter of the cavity 12 to cavitator tip diameter ratio is given by:

$$\mu=\sqrt{\frac{C_D(1+\sigma)}{\sigma(1-0.132\sigma^{1/7})}}$$

The second parameter, the slenderness ratio of the cavity 12, ½R, is given by:

$$\lambda=1.067\sigma^{-0.658}-0.52\sigma^{0.465}$$

The drag coefficient of a disc cavitator is assumed equal to 0.814. An equivalence is assumed between a jet and a disc. A forward jet cavitator of known cross sectional area will produce a cavity equivalent in size and characteristics to a disc 20.5% of the size.

The required forward directed jet velocity can be estimated from energy balance considerations. The rate of work done by the jet front is the product of the drag force of the equivalent disc cavitator multiplied by the speed of advancement of the jet front, e.g.:

$$Power_{out}=\frac{1}{2}\rho_{fluid}U_f^2A_{equiv}C_dU_f$$

The energy flux into the jet front as supplied by the high-speed jet is computed relative to the advection speed of the front. This energy is then given by:

$$Power_{in}=\left(\frac{1}{2}\rho_{jet}(U_{jet}-U_f)^2A_{jet}\right)(U_{jet}-U_f)$$

Setting these two expressions equal to each other provides a relationship between required jet velocities to sustain a propagating jet front as a function of a few key parameters:

$$\frac{\rho_{fluid}}{\rho_{jet}}=\frac{A_{jet}}{A_{equiv}C_d}\left(\frac{U_{jet}-U_f}{U_f}\right)^3$$

If the density ratio is assumed equal to 1.0 (water jet into water), the area ratio is assume equal to 0.205, and the drag coefficient is equal to 0.814, the required jet velocity is 1.55 times the front advance speed. If high density jets are considered, the required jet velocity is somewhat lower, 1.28 for a specific gravity of 8.0. The extent of penetration of the jet for a given velocity is improved, but for a specified dynamic head, the penetration is considerably less. Inversely, a light liquid can be fired a range for a specified dynamic head.

Dynamics play an important role in the jet concept. A steady jet from a stationary platform cannot sustain a supercavity. The jet must be pulsed to reap the benefits of supercavitation.

FIG. 3 illustrates the transient nature of a pulsed supercavitating jet 30. It is assumed that the water jet emerges at its maximum speed $U_{jet}$. As soon as the jet begins (point 1), a front forms at the exit of a nozzle 32 and a supercavity is created. As fluid feeds the front from the left, the existing portion of the supercavity expands (point 2) and the jet front propagates to the right at $U_f$. After an amount of time, the parts of the supercavity originally formed by the start of the jet 30, collapse back onto the fluid stream (point 3). At this point in time the state of the system is an elliptical cavity with a core (point 4). The front continues to be fed by the jet 30 in the core of the supercavity and it proceeds to the right. Material in the core is consumed at the front until there is no longer any fluid inside the supercavity 30 (point 5). The supercavity 30 then collapses as the closure point catches up to the maximum penetration of the front (points 6 and 7).

The geometry of the jet 30 determines the total water consumed and range of the jet. The total penetration length is the length of the cavity plus the distance the trapped core can drive the front after the cavity closes. This extra length is simply determined as:

$$L_{fp} = \frac{U_f L_{cav}}{(U_{jet} - U_f)}$$

The total volume v of material consumed in forming the jet 30 is the volume in the core plus the fluid required to drive the front out to one length of the cavity from the nozzle 32.

$$V = A_{jet}\left(L_{cav} + L_{cav}\frac{U_{jet}}{U_f}\right)$$

In real world applications, high velocity jets are used in industrial systems for cutting operations. Pressures of 380 Mpa (50,000 psi), generated with specialized hydraulic pumps, and are used to generate very small diameter fluid jets with speeds approaching 800 m/s. These systems are designed for precision continuous cutting. As such, jet diameters are typically very small (no greater than 1 mm). Jet pulses of this size can only penetrate a very short distance (of the order 1 meter) in the water based on the equations described above. Power consumption for significantly larger jets becomes prohibitive if sustained operation is required.

SUMMARY OF THE INVENTION

Accordingly, it is a general purpose and primary object of the present invention to provide a method of producing a long distance fluid jet using a pulsing system in which the jet is also useable as a weapon.

To obtain the object described, the present invention features a system and method for producing a pulsed jet with the pulsed jet preferably used as an underwater weapon. High density materials and particulate laden jet streams enhance the penetration of the pulsed jet and lethal effects by varying the density of the pulsed jet. The use of molten metals further enhances the jet penetration.

BRIEF DESCRIPTION OF THE DRAWINGS

These and other features and advantages of the present invention will be better understood in view of the following description of the invention taken together with the drawings wherein.

DESCRIPTION OF THE PREFERRED EMBODIMENT

The following is a detailed description of the preferred embodiment of the present invention. It will be appreciated that while one embodiment will be described hereinbelow, there are many different embodiments (such as various intake/discharge valve systems, filling systems, and nozzle systems) that will perform the desired functions. As such, the present application should not be limited to one specific embodiment.

Figure 1:
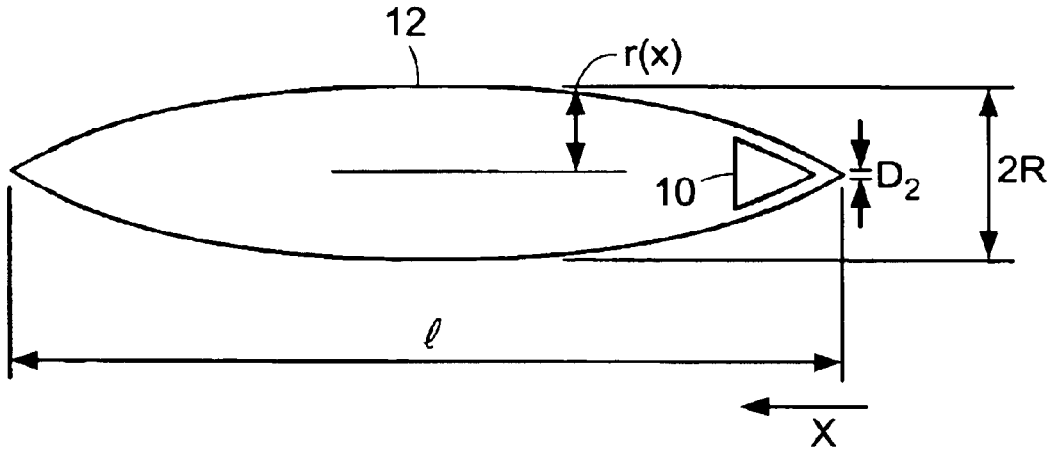
FIG. 1 PRIOR ART
FIG. 1 is a prior art schematic view of a projectile and a cavity.
Figure 2:
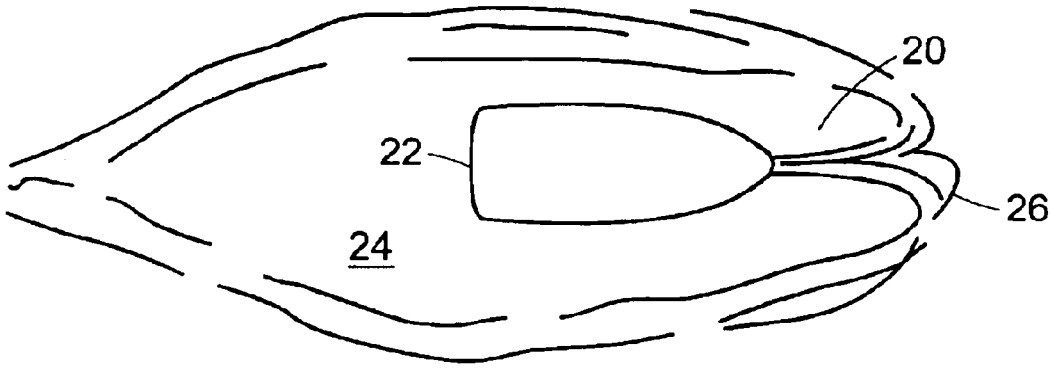
FIG. 2 PRIOR ART
FIG. 2 is a prior art schematic view of a projectile having a forward facing jet forming a cavity.
Figure 3:
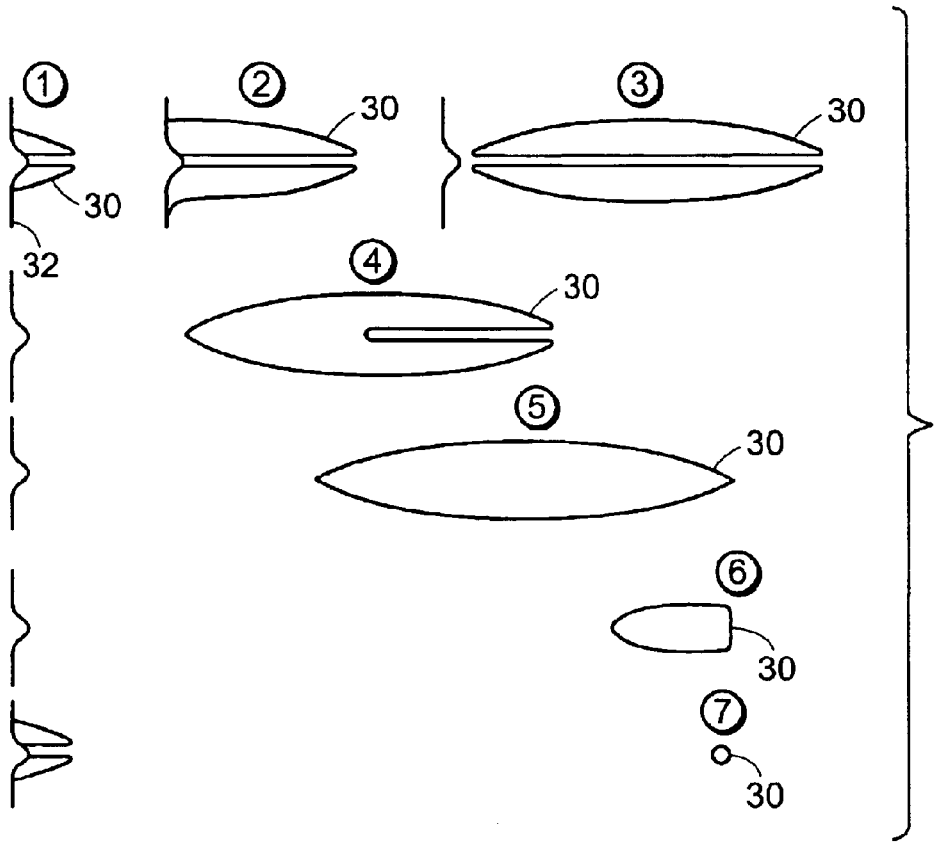
FIG. 3 PRIOR ART
FIG. 3 is a prior art diagram of the different stages of a cavity formed by a pulsed jet.
Figure 4:
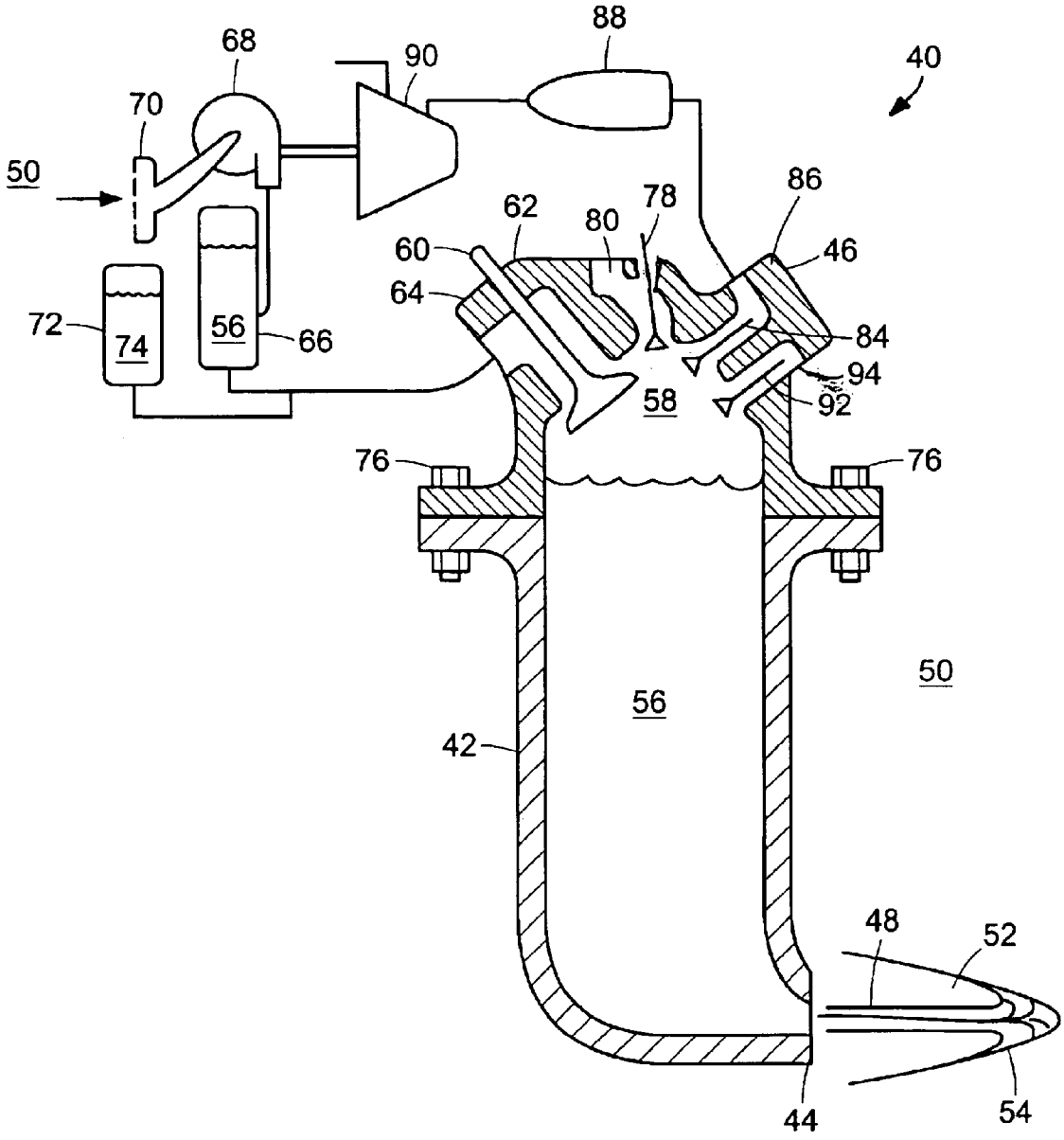
FIG. 4 is a schematic view of the pulsed jet generating system according to the present invention.

Referring now to FIG. 4, a pulsed jet generating system 40 is shown. The pulsed jet system 40 generally comprises a pressure chamber 42, a nozzle 44, and a supporting manifold 46. The pulsed jet system 40 preferably operates from a submerged platform (not shown) such as a torpedo, submarine, or other unmanned underwater vehicle.

In operation, the pulsed jet system 40 produces a jet stream 48 which travels a significant distance (for example, in the range of 5 to 50 m) through the surrounding water 50 to produce a cavity 52 with a jet 54 until the jet strikes a target (not shown) or the jet collapses. The pulsed jet system 40 is preferably a combustion driven system, though other means of driving the pulsed jet system are possible.

In further description of the operation, the pressure chamber 42 is filled with a fluid 56 (preferably water or water with a particulate, discussed in greater detail hereinbelow). A fuel mixture 58 is injected within the pressure chamber 42 and adjacent the fluid 56. The fuel mixture 58 is ignited to create an intense pressure that drives the fluid 56 from the pressure chamber 42 through the nozzle 44.

If the pressure chamber 42 is full of low pressure air and all valves for the pressure chamber are closed, the pulsed jet system 40 begins by opening an intake valve 60 in the head 62. The intake valve 60 reacts by monitoring the pressure within the pressure chamber 42 and/or the level of the fluid 56. The fluid 56 is forced through the intake manifold 64 from an accumulator 66. The accumulator 66 is continuously fed by a pump 68 that draws the fluid 56 through an intake 70 from the surrounding water 50. The accumulator 66 may also contain a limited supply of the fluid 56 which is not automatically refilled in situations where the pulsed jet system 40 will be operating for short time periods.

While the present invention has heretofore been described wherein the working fluid 56 is water, any other fluid, including liquids metals, combustible or reactive materials and particulate laden fluids can be used. The pulsed jet system 40 may also contain a tank 72 containing a particulate 74 (such as sand) which may be added to the liquid or fluid 56 in order to increase or decrease the density of the jet stream 48.

When the pressure chamber 42, connected to the head 62 with fasteners 76, is fully charged with the fluid 56, the intake valve 60 is closed. A fuel injection valve 78 is then opened such that fuel and air are injected through the fuel intake manifold 80 into as a combustion volume. Any material, such as but not limited to, liquid propellants, explosive capsules, combustible gas, etc., capable of producing pressure within the pressure chamber 42 may also be used. During the injection of the fuel, the fluid 56 is free to escape from the nozzle 44.

When the pressure chamber 42 is fully charged with fuel, the fuel injection valve 78 is closed and the fuel/air mixture is ignited by an igniter (not shown). A rapid rise in pressure within the pressure chamber 42 forces the fluid 56 from the pressure chamber through the nozzle 44 to form the supercavitating jet 54. Optimal performance is obtained when the combustion rate of the fuel is controlled so that a constant pressure in the combustion chamber 42 is maintained resulting in a constant velocity for the jet 54 during repetition of the operation for pulsation.

When the pressure chamber 42 is almost emptied (or the pressure within the pressure chamber drops below a threshold value), a power-take-off valve 84 is opened allowing the compressed gases to flow through a power take-off manifold 86 into a secondary pressure vessel 88. Alternatively, the combustion gasses may simply be vented to the surrounding water 50. These combustion gases can alternatively be supplied to a gas turbine 90 which in-turn drives the pump 68.

Prior to opening the intake valve 60 to begin the cycle again for the pulsed jet system 10, the power take-off valve 84 is closed and a chamber vent valve 92 is opened allowing the remaining pressurized gases to escape through the vent manifold 94 to the surrounding water 50. The power take-off valve 84 is preferably controlled by monitoring the pressure within the pressure chamber 42 as well as the level of the fluid 56. This cycle is repeated for each jet 54. The individual components are sized to achieve the desired firing rates, jet size, and extent of penetration and are within the knowledge of one of ordinary skill in the art.

The head 62 may include one or more cams (not shown) to control the opening and closing of the various valves. Alternatively, the pulsed jet 54 may monitor the pressure chamber 42 pressures and fluid levels to control the opening and closing of the valves associated with the pressure chamber.

In light of the above, it is therefore understood that within the scope of the appended claims, the invention may be practiced otherwise than as specifically described.

What is claimed is:

1. A method of generating a pulsed undersea weapon, said method comprising the steps of:

filling a chamber with a fluid to a predetermined level;

injecting fuel into the chamber adjacent the fluid;

igniting the fuel to generate a combustion gas within the chamber creating a pressure within the chamber by said combustion gas;

ejecting by said created pressure at least a portion of the fluid from a nozzle in fluid communication with the chamber to an undersea environment wherein the ejected fluid forms a jet in the undersea environment;

removing at least a portion of said combustion gas from the chamber;

powering a pump with said removed combustion gas; and repeating to a predetermined amount and subsequent to the removal step, the steps of said method thereby increasing the force of said previously ejected jet as a pulsed undersea weapon.

2. The method in accordance with claim 1 wherein said step of powering a pump with said combustion gas occurs when the fluid in said chamber reaches a predetermined level.

3. A method of generating a pulsed undersea weapon, said method comprising the steps of:

filling a chamber with a fluid to a predetermined level;

mixing the fluid with a particulate during said filling step;

injecting fuel into the chamber adjacent the fluid;

igniting the fuel to generate a combustion gas within the chamber creating a pressure within the chamber by said combustion gas;

ejecting by said created pressure at least a portion of the fluid from a nozzle in fluid communication with the chamber to an undersea environment wherein the ejected fluid forms a jet in the undersea environment;

removing at least a portion of said combustion gas from the chamber; and repeating to a predetermined amount and subsequent to the removal step, the steps of said method thereby increasing the force of said previously ejected jet as a pulsed undersea weapon.

4. The method in accordance with claim 3 wherein the step of removing said portion of said combustion gas further includes powering a pump with said combustion gas.

5. The method in accordance with claim 3 wherein said step of removing said portion of said combustion gas further includes powering a pump with said combustion gas when the fluid in said chamber reaches a predetermined level.

6. The method in accordance with claim 3 wherein said step of injecting the fuel into said chamber includes injecting the fuel such that the pressure in said chamber is substantially maintained during said ejecting step.

7. An assembly for producing a pulsed jet as a weapon for an undersea environment, said assembly comprising:

a containment chamber in fluid communication with a source of fluid and a source of fuel;

an igniter within said containment chamber for forming a pressurized combustion gas within said containment chamber by igniting the fuel within said containment chamber thereby pressurizing the fluid;

a nozzle in fluid communication with said containment chamber, with said nozzle suitable as an egress to the pressurized fluid such that the pressurized fluid emitting from said nozzle forms a cavitating jet downstream of said egress and within the undersea environment;

an exhaust passageway in fluid communication with said containment chamber, said exhaust passageway capable of the removing varying amounts of the combustion gas from said containment chamber;

a controller capable of controlling a constant rate of fuel ignition and a flow rate of the fuel from the fuel source such that a substantial pressure of the pressurized combustion gas is maintained; and a container for a particulate, said container in fluid communication with the containment chamber thereby allowing the particulate to be combined with the fluid.

8. The assembly in accordance with claim 7 further comprising:

a first valve positioned at said containment chamber, said first valve capable of regulating an amount of the fluid entering said chamber;

a second valve positioned at said chamber, said second valve capable of regulating an amount of the fuel entering said chamber; and a third valve positioned at said chamber, said third valve capable of regulating an amount of the combustion gas exiting said chamber.

9. The assembly in accordance with claim 8 further comprising a controller capable of controlling said first, second and third valves.

10. The assembly in accordance with claim 9 said assembly further comprising a pump in fluid connection from the fluid source to said chamber, said pump powerable by the combustion gas removed from said chamber.

* * * * *